US009975371B2

(12) United States Patent
Koullouros

(10) Patent No.: US 9,975,371 B2
(45) Date of Patent: May 22, 2018

(54) UPRIGHT NOTE HOLDER

(71) Applicant: Eric Koullouros, Waterloo (AU)

(72) Inventor: Eric Koullouros, Waterloo (AU)

( * ) Notice: Subject to any disclaimer, the term of this patent is extended or adjusted under 35 U.S.C. 154(b) by 0 days. days.

(21) Appl. No.: 14/149,114

(22) Filed: Jan. 7, 2014

(65) Prior Publication Data

US 2015/0008200 A1 Jan. 8, 2015

Related U.S. Application Data

(63) Continuation of application No. 11/909,900, filed as application No. PCT/AU2006/000419 on Mar. 29, 2006, now Pat. No. 8,668,095.

(30) Foreign Application Priority Data

Mar. 29, 2005 (AU) ..... 2005901517

(51) Int. Cl.

| | |
|---|---|
| ***B42F 7/06*** | (2006.01) |
| ***A47F 7/14*** | (2006.01) |
| ***B42D 5/00*** | (2006.01) |
| ***G09F 1/10*** | (2006.01) |
| ***B42F 7/12*** | (2006.01) |

(52) U.S. Cl.

CPC ..... *B42F 7/06* (2013.01); *A47F 7/143* (2013.01); *B42D 5/005* (2013.01); *B42F 7/12* (2013.01); *G09F 1/10* (2013.01)

(58) Field of Classification Search

USPC .... 211/13.1, 17, 85.15, 46, 47, 48, 57.1, 72, 211/45, 50, 113; 248/451, 456, 910; 281/45; 40/652

See application file for complete search history.

(56) References Cited

U.S. PATENT DOCUMENTS

| | | | | | |
|---|---|---|---|---|---|
| 765,578 | A | * | 7/1904 | Holman | A47F 5/04 211/57.1 |
| 1,373,070 | A | * | 3/1921 | Hill | 40/401 |
| 1,668,429 | A | * | 5/1928 | Simon | 24/67.11 |
| 1,730,241 | A | * | 10/1929 | Porter | 40/652 |
| 1,822,175 | A | * | 9/1931 | Snyder | A47B 97/04 211/50 |
| 2,116,386 | A | * | 5/1938 | Copeland | 211/85.15 |
| 2,186,436 | A | * | 1/1940 | Saul | 40/389 |
| 2,638,903 | A | * | 5/1953 | Rudolph et al. | 40/398 |
| 2,868,385 | A | * | 1/1959 | Dreyfus, Jr. | 211/85.31 |
| 2,913,843 | A | * | 11/1959 | Wittick | 211/45 |
| 2,937,758 | A | * | 5/1960 | Tabb | 211/1 |
| 3,473,671 | A | * | 10/1969 | Gangitano | 211/45 |
| 3,498,469 | A | * | 3/1970 | Hummel | 211/85.15 |
| 3,967,346 | A | * | 7/1976 | Young, Jr. | 211/89.01 |
| 3,979,845 | A | * | 9/1976 | Janssen | 40/375 |
| 4,712,760 | A | * | 12/1987 | Winter | A47B 23/06 248/451 |
| 4,783,918 | A | * | 11/1988 | Valery | 40/124 |
| 4,938,368 | A | * | 7/1990 | Sharman | 211/57.1 |
| 5,102,087 | A | * | 4/1992 | Brunell | 248/451 |

(Continued)

*Primary Examiner* — Patrick D Hawn

(74) *Attorney, Agent, or Firm* — Fox Rothschild LLP

(57) ABSTRACT

A note holder is disclosed that comprises a base; a spine extending from the base and having a base end and an upper end, the upper end being positioned higher than the base end in the vertical plane; and, a plurality of retainers attached to said spine and adapted to retain one or more pieces of notepaper in an easily observed state.

5 Claims, 3 Drawing Sheets

(56) References Cited

U.S. PATENT DOCUMENTS

| | | | | | |
|---|---|---|---|---|---|
| 5,115,921 | A * | 5/1992 | Lavelle | 211/85.15 |
| 5,601,193 | A * | 2/1997 | Santoya | 211/11 |
| 5,967,341 | A * | 10/1999 | Werner | 211/85.15 |
| 6,237,782 | B1 * | 5/2001 | Hunn | 211/47 |
| 6,312,183 | B1 * | 11/2001 | Arnold | 402/79 |
| 6,519,868 | B1 * | 2/2003 | Pryor et al. | 33/832 |
| 7,219,459 | B2 * | 5/2007 | Valiulis et al. | 40/673 |
| 2007/0113452 | A1 * | 5/2007 | Pollack | 40/658 |

* cited by examiner

UPRIGHT NOTE HOLDER

TECHNICAL FIELD

An upright holder for holding notes in an easily observed state is disclosed. More particularly, an upright holder for suspending sheet material such as paper notes or photographic film using a plurality of retaining clips is disclosed.

BACKGROUND ART

Upright holders are known in several different embodiments and comprise several different structural parts consisting of different materials, which makes the production of them relatively complicated and expensive. Further, known holders are generally not aesthetically pleasing and do not incorporate a tidy way to store note paper along with a plurality of notes in an easily observed state.

SUMMARY OF THE DISCLOSURE

A note holder is disclosed that comprises a base; a spine extending from the base and having a base end and an upper end, the upper end being positioned higher than the base end in the vertical plane; and, a plurality of retainers attached to said spine and adapted to retain one or more media sheets in an easily observed state.

In one form the base comprises one or more storage trays adapted to hold media sheets.

In one form, each of the plurality of retainers is integral to the spine.

In one form, each of the plurality of retainers comprises a flexible element which is mounted to the spine at least at one point and extends across at least a portion of the width of the spine.

In one form, the spine includes a plurality of orifices and each flexible element extends from a respective one of the plurality of orifices.

In one form, the stand comprises a container holding a heavy granular material.

BRIEF DESCRIPTION OF THE DRAWINGS

It is convenient to hereinafter describe an embodiment of a note holder with reference to the accompanying drawings. It is to be appreciated that the particularity of the drawings and the related description is to be understood as not superseding the generality of the preceding broad description.

In the drawings.

DETAILED DESCRIPTION OF SPECIFIC EMBODIMENTS

Figure 1:
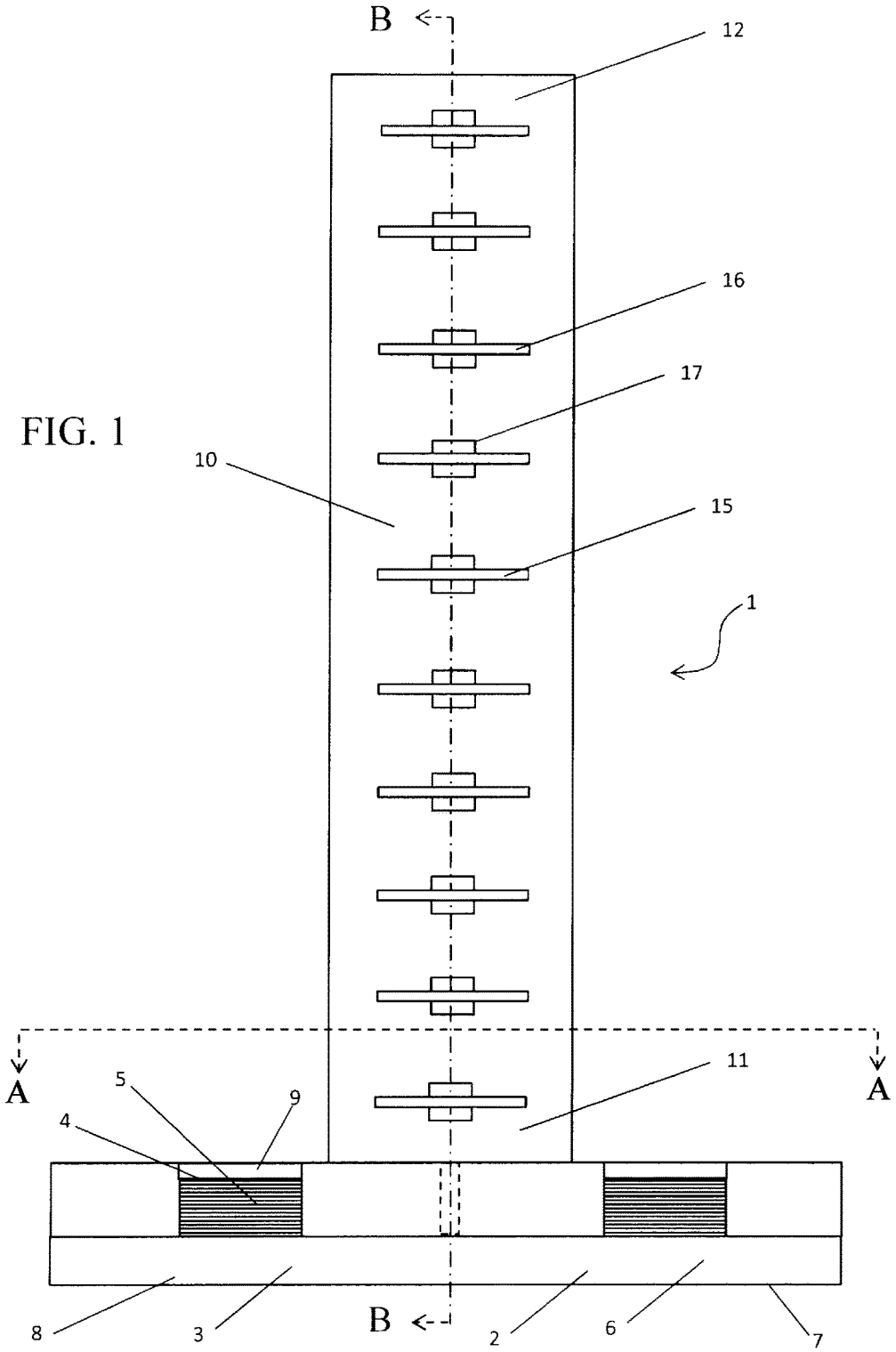
FIG. 1 is a front elevation view of a note holder.
Figure 2:
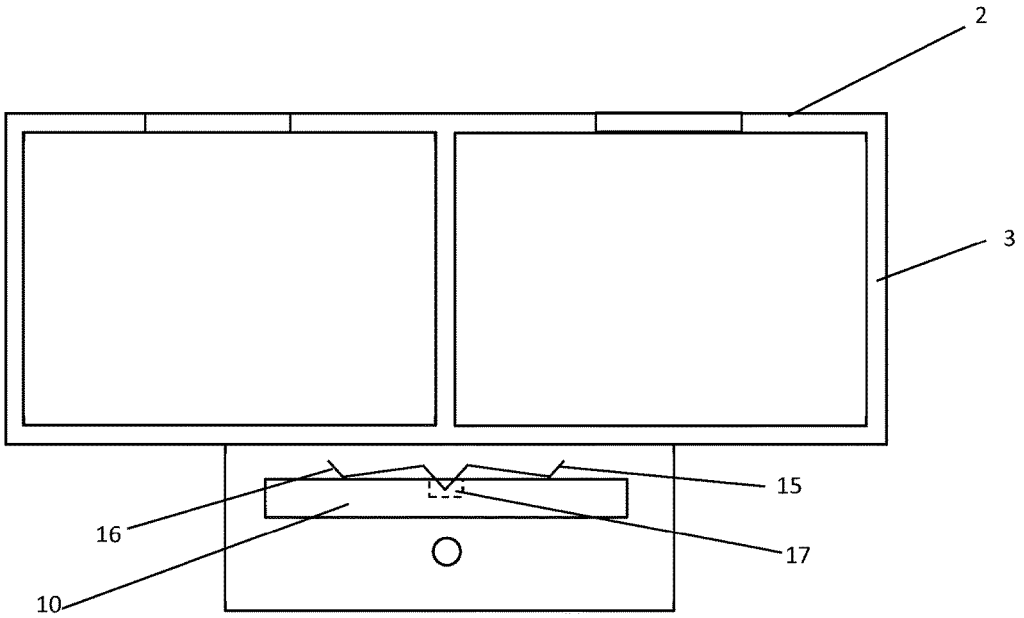
FIG. 2 is a cross-sectional view of a FIG. 1 through A-A.
Figure 3:
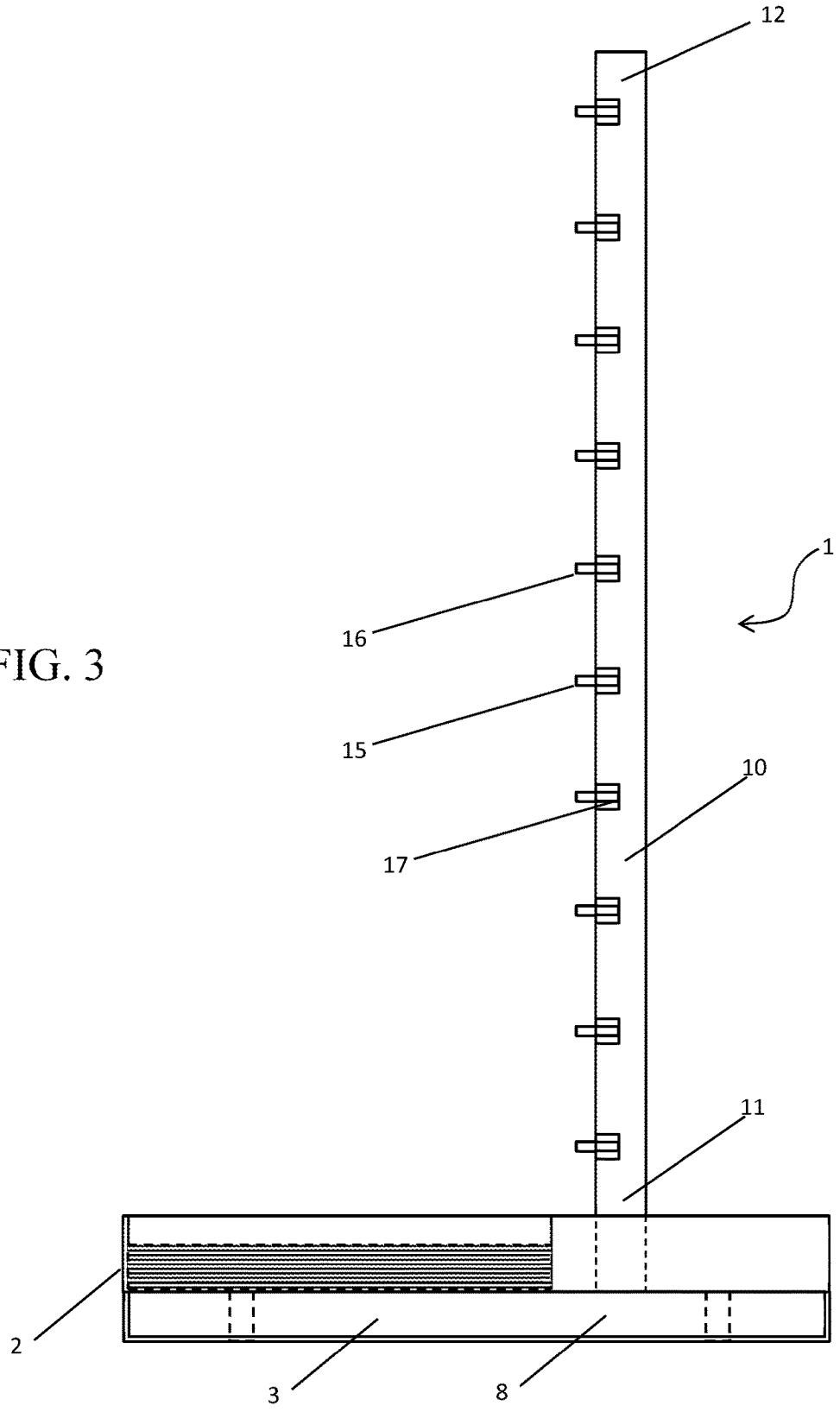
FIG. 3 is a cross-sectional view of FIG. 1 through B-B.

Referring to the figures, disclosed is a note holder 1 which includes a base 2. The base 2 comprises a stand 3 and at least one storage element 4. The stand 3 is adapted to be placed on a table or other surface (not illustrated). The storage element 4 is incorporated into the base 2 and stand 3 and is adapted to retain a plurality of media sheets, in this case pieces of note paper 5. The storage elements 4 comprise a storage cavity 9 which is shaped to retain the pieces of note paper 5. These pieces of note paper 5 could comprise adhesive backed memo paper or other small pieces of note paper.

The stand 3 comprises a closed container 6, composed of walls 7 around a hollow interior cavity 8. The hollow interior cavity 8 holds a heavy granular material, such as sand, a heavy fluid such as water, or heavy solids such as metal or other heavy blocks. Alternatively, the stand 3 comprises a solid piece of metal or other heavy material.

The note holder 1 further comprises a spine 10 extending upwardly from the base 2. The spine 10 has a base end 11 and an upper end 12. The spine 10 is designed to extend upwardly from the base 2 such that the upper end 12 is positioned higher than the base 2 in the vertical plane. In one form, the spine 10 extends perpendicularly to the stand 3. In another form, the spine 10 is curved or zig-zag shaped or extends at any angle to the stand 3.

The note holder 1 further comprises a plurality of retainers 15. In one form, each of the plurality of retainers 15 is attached to the spine 10. In this form each of the plurality of retainers 15 comprises an elongate member 16 extending across at least a portion of the width of the spine 10. The elongate member 16 abuts the spine 10 at least at one point. In use, the piece of notepaper 5 can be slipped under the elongate member 16 and pinned to the spine 10 at the point where the elongate member 16 abuts the spine 10. The elongate member 16 is composed of a flexible material such as a bendable metal or plastic.

The spine 10 includes a plurality of orifices 17 cut into the spine. The retainer 15 extends from the orifices 17 across at least a portion of the width of the spine 10.

In one form the retainer 15 is integral to the spine 10. In this form the spine 10 is composed of a flexible metal or plastic material that is appropriate for the composition of the retainer 15.

In one form the spine 10 is hollow and includes an inner spine (not illustrated) which extends behind the orifices 17 up at least a portion of the length of the spine 10. In this form, the plurality of retainers 15 is attached with the inner spine.

In one form the retainers 15 include a central divider (not illustrated) which is positioned at approximately the centre of the retainers 15. The central divider is adapted such that a media sheet positioned in the retainer abuts the central divider allowing the media sheet to be easily aligned with the vertical.

In one form the spine 10 is moveable or flexible such that the spine 10 can be positioned at an angle to the vertical plane allowing a user to easily view the media sheets retained by the retainers 15.

In use, the note holder 1 stands on a surface such as a table. A user can utilise the pieces of note paper 5 which are stored within the storage element 4 on the base 2. Notes can be written on the pieces of note paper 5. The spine 10 is adapted to have notes clipped thereto. Each of the notes can be held by one or two or more of the plurality of retainers 15. The notes are therefore held in an easily observed state. This avoids the loss of notes and keeps them in an aesthetically pleasing manner.

In the claims which follow and in the preceding description of the note holder, except where the context requires otherwise due to expressed language or necessary implication, the word "comprise" or variations such as "comprises" or "comprising" is used in an inclusive sense, that is to specify the presence of the stated features but not to preclude the presence or addition of further features in various embodiments of the note holder.

Variations and/or modifications may be made to the parts previously defined without departing from the broad spirit or ambit of the note holder.

The invention claimed is:

1. A holder comprising:

a base stand;

a spine extending from the base stand and being supported in a substantially upright orientation by the base stand, the spine extending upwardly from the base stand and having a lateral width such that at least a portion of the spine forms a plane; and a plurality of flexible retainers attached to the spine, the retainers having elongate bodies and extending laterally across at least a portion of the plane and substantially parallel with the plane, the flexible retainers each defining at least one insertion cavity with the spine, each insertion cavity extending from a closed end at which the retainer is fixedly attached with the spine, to an open end, the open end being horizontally spaced apart from the closed end, the retainers extending across the spine a distance such that a media sheet located in the insertion cavity and biased into contact with the spine is held such that a rear surface of the media sheet is in alignment with the spine and a front surface of the media sheet is in a viewable configuration, the retainers being vertically aligned and positioned such that the closed end of a given retainer is vertically spaced apart from the closed end of an adjacent retainer.

2. A holder as defined in claim 1, wherein the closed end of each retainer is fixedly attached to the spine and a portion of each retainer spaced from the closed end is biased to a first position which is proximal a face of the spine and is movable away from the spine to a second position in which the portion of the retainer is spaced from the face of the spine.

3. A holder as defined in claim 1, wherein the closed ends of the retainers are located at one end of each retainer and include an abutment portion facing into the insertion cavity, and the abutment portions are oriented in the insertion cavity such that an edge surface media sheet inserted in the insertion cavity abuts the abutment portion of the closed ends.

4. A holder as defined in claim 3, wherein the insertion cavity extends uninterrupted from the closed end to the open end.

5. A holder as defined in claim 1, wherein the base stand has a lower surface that extends in both the direction of the plane of the spine and transverse to that direction to form a base having a larger cross sectional diameter than the spine.

* * * * *